US008801498B2

(12) United States Patent
Hammond et al.

(10) Patent No.: US 8,801,498 B2
(45) Date of Patent: Aug. 12, 2014

(54) FINISHER WITH ON-BOARD LOADING AND UNLOADING MECHANISM

(75) Inventors: Jeremy Paul Hammond, Portage, MI (US); Kyle James Elmblad, Portage, MI (US); Stuart William Quick, Mattawan, MI (US)

(73) Assignee: Hammond Machinery, Inc., Kalamazoo, MI (US)

( * ) Notice: Subject to any disclaimer, the term of this patent is extended or adjusted under 35 U.S.C. 154(b) by 593 days.

(21) Appl. No.: 13/199,701

(22) Filed: Sep. 7, 2011

(65) Prior Publication Data

US 2012/0064804 A1 Mar. 15, 2012

Related U.S. Application Data

(60) Provisional application No. 61/403,161, filed on Sep. 10, 2010.

(51) Int. Cl.

| | |
|---|---|
| ***B24B 31/06*** | (2006.01) |
| ***B24B 31/108*** | (2006.01) |
| ***B24B 31/16*** | (2006.01) |
| ***B24B 57/02*** | (2006.01) |

(52) U.S. Cl.

CPC ..... *B24B 31/16* (2013.01); *B24B 31/108* (2013.01); *B24B 57/02* (2013.01)

USPC ..... 451/32; 451/104; 451/113; 451/327; 451/331

(58) Field of Classification Search

CPC ..... B24B 1/00; B24B 31/06; B24B 31/16; B24B 31/073; B24B 31/108

USPC ..... 451/32, 104, 113, 326, 327, 331

See application file for complete search history.

(56) References Cited

U.S. PATENT DOCUMENTS

| | | | | | |
|---|---|---|---|---|---|
| 3,751,861 | A | * | 8/1973 | Frost et al. | 451/35 |
| 3,893,266 | A | * | 7/1975 | Anderson et al. | 451/327 |
| 3,955,714 | A | * | 5/1976 | Boyes et al. | 222/132 |
| 4,001,979 | A | * | 1/1977 | Elkins et al. | 451/327 |
| 4,241,545 | A | * | 12/1980 | Anderson et al. | 451/327 |
| 5,012,620 | A | | 5/1991 | McNeil | |
| 5,733,172 | A | * | 3/1998 | Nishimura et al. | 451/32 |

FOREIGN PATENT DOCUMENTS

| | | | |
|---|---|---|---|
| GB | 2 094 192 | A | 9/1982 |
| GB | 2 158 751 | A | 11/1985 |

OTHER PUBLICATIONS

United Kingdom Search Report issued in corresponding U.K. Application No. 1115570.2 dated Jan. 6, 2012 (3 pages).

* cited by examiner

*Primary Examiner* — Timothy V Eley

(74) *Attorney, Agent, or Firm* — Flynn, Thiel, Boutell & Tanis, P.C.

(57) ABSTRACT

A finisher arrangement for surface finishing of parts, including a bowl-type centrifugal finishing device for agitating a mixture of parts and treating media within the bowl, and a handler for loading and unloading the parts/media to and from the bowl, respectively. The finishing device and handler are positioned sidewardly adjacent but on opposite sides of a rotary drive unit which defines a transfer horizontal drive axis. Arm linkages couple each of the finishing device and handler to the drive unit so that each is independently vertically swingable about the drive axis into respective loading and unloading positions.

22 Claims, 11 Drawing Sheets

FINISHER WITH ON-BOARD LOADING AND UNLOADING MECHANISM

CROSS REFERENCE TO RELATED APPLICATION

This application claims the benefit of U.S. Provisional Application No. 61/403,161, filed Sep. 10, 2010, the disclosure of which is hereby incorporated by reference in its entirety.

FIELD OF THE INVENTION

This invention relates to a finisher arrangement for surface finishing of loose parts, which arrangement includes a centrifugal surface finishing apparatus having loading and unloading mechanisms integrated therewith to facilitate loading and unloading of parts and media into and out of the finishing apparatus, and also relates to a process for operating such arrangement.

BACKGROUND OF THE INVENTION

Finisher arrangements for surface finishing of parts by effecting movement of parts within media contained within an upwardly-opening bowl-shaped finishing apparatus are well known, and the finishing operation carried out by such apparatus is well understood. Frequently such finishing apparatus is provided with suitable associated hardware, including mechanisms, to facilitate loading, as well as unloading, of parts and media into or out of the bowl. Such arrangements have typically employed a container or hopper arrangement for permitting media and/or parts to be deposited therein, with the hopper then being moved to permit the parts to be discharged through the upper open mouth of the bowl into the finishing chamber. The movement of the hopper has, in known instances, employed swinging arms which enable vertical swinging of the hopper from a lowered filling position into a raised position above the finishing bowl for permitting discharge of the hopper contents. Such apparatus is also known wherein the finishing bowl itself is mounted for vertical swinging movement to permit the contents thereof, upon completion of the finishing operation, to be discharged from the bowl back into a hopper. In this known arrangement, however, the hopper and the bowl are provided with separate swing arm mechanisms which move about wholly separate and distinct swing axes. In addition, the swinging mechanisms associated with the hopper and the finishing bowl are independently driven by separate power devices. This arrangement results in the overall arrangement being of greater size and bulk, of greater structural complexity, and hence of greater overall cost.

Arrangement of the aforementioned type have caused the parts, when discharged from the hopper into the finishing bowl to be dropped vertically through a substantial distance, and a substantial vertical drop is also normally encountered when the finished parts are discharged from the bowl back into the hopper. This significant vertical dropping of the parts during transfer has been observed to cause undesirable hitting and impacting of the parts against one another, which can be damaging to the surface finish of the parts, particularly in the case of delicate and/or high precision parts.

In addition, in the apparatus of the aforementioned type, the rotor adjacent the bottom of the finishing bowl is typically rotated only throughout the actual finishing operation, but is maintained stationary during loading of the parts into the finishing bowl, and is also maintained stationary (i.e., non-rotating) when the bowl is swingably moved into a discharge position. This stationary condition of the bowl rotor, however, is believed to cause the parts, when deposited into or discharged from the bowl, to be transferred under conditions which results in more contacting and impacting of the parts with one another.

Accordingly, it is an object of this invention to provide an improved finisher arrangement for parts, which finisher arrangement includes a centrifugal-type finishing bowl having improved mechanisms and hardware associated therewith to facilitate swinging movement of both a hopper and the bowl to facilitate respective loading and unloading of parts and finishing media. The overall arrangement of this invention is believed to provide improved structural and operational simplicity, and more specifically a smaller and more compact overall arrangement which facilitates operation of the arrangement and provides improved access and visibility.

It is also an object of this invention to provide an improved operational process for such arrangement, which process includes maintaining slow rotational movement of the bowl rotor both when parts and media are deposited into the bowl, and when the bowl is in its raised and tilted position to discharge the parts and media into a collecting structure. The slow rotation of the rotor, both during loading and unloading of the bowl, and its action on the parts and media within the bowl, is capable of effecting greater spreading of the parts over the bottom of the bowl, rather than permitting the parts to bunch more closely together such as typically occurs when rotor rotation is stopped. This slow rotation of the rotor hence prevents the parts from being deposited or discharged in a large mass, but rather spreads the deposited or discharged the parts more uniformly over the depositing or discharge time cycle, thereby minimizing impacting between the parts when they undergo the transfer motion.

A further object of the invention, as aforesaid, is to provide the overall arrangement with minimal vertical drop between the bowl and the hopper arrangement, both when the hopper is positioned over the bowl to permit deposit of parts and media therein, and when the bowl is positioned in tilted relationship above the hopper assembly to discharge parts and media thereto. This minimal discharge or drop distance is particularly achieved in the arrangement of this invention by supporting the hopper in a geometric relationship relative to the bowl so that, when the hopper is swung upwardly into position over the bowl, the lower part of the hopper projects downwardly into the interior of the finishing chamber defined by the bowl. This relationship, combined with the provision of an openable discharge passage defined at the bottom of the hopper, permits the parts and media to be vertically dropped a very small and substantially minimal distance when deposited from the hopper onto the bottom wall of the bowl.

Other objects and purposes of the invention will be apparent to persons familiar with arrangements of this general type upon reading the following specification and inspecting the accompanying drawings.

SUMMARY OF THE INVENTION

The finishing arrangement of this invention includes a simple compact frame having an upright pedestal provided with a rotary drive device, such as a rotary hydraulic actuator, mounted thereon and disposed so that a drive shaft thereof projects transversely and generally horizontally of the frame. A centrifugal-type finishing device of generally conventional construction, namely an upwardly opening bowl having a rotatable rotor defining the bottom of a finishing chamber, is disposed closely adjacent one side of the rotary actuator. A parts/media handling device is normally positioned closely adjacent the other side of the rotary actuator. A pair of driving arm mechanisms are disposed adjacent opposite sides of the frame so as to straddle the centrifugal finishing bowl and the parts/media handling device. Each arm arrangement includes a first elongate arm which at one end is fixed to the bowl and at its other end is rotatably supported on the drive shaft and cooperates with an engagable coupling device so as to be drivingly coupled to the drive shaft to effect upward swinging of the bowl into a discharged position upon activation of the rotary actuator. Each arm arrangement also includes a second elongate arm which has its inner end rotatably engaged with the drive shaft and its outer end rotatably engaged with the parts/media handling device. This second arm also cooperates with a second coupling device which, when engaged, enables the second arm to be vertically swingably displaced by the rotary actuator to swing the handling device into a position wherein a hopper associated with the device is positioned over and projects down into the bowl to permit depositing of media and parts therein. The second arm also has an anti-tilt mechanism associated therewith so that, when the second arm is swingably displaced, the parts/media handling arrangement remains in a level or generally horizontal orientation. The first and second arms both swingably move about the same transverse axis, namely the axis defined by the drive shaft associated with the rotary actuator, and the disposition of the bowl and handling apparatus directly adjacent and on opposite diametrical sides of the rotary actuator when they are in their normal lowered positions, simplifies and minimizes the overall size of the apparatus and of the required frame, and facilitates access and visibility on behalf of operating personnel. The parts/media handling device, in addition to the hopper, includes a tray arrangement disposed above the hopper and including an upper grate which permits separation of parts from media and liquid, with media and liquid passing vertically downwardly through the grate to a screen disposed therebelow, which screen permits liquid to pass vertically downwardly for collection, with the media collecting on the screen being discharged into the hopper.

In the operation of the arrangement as described above, when the hopper is swung upwardly into a position over the finishing bowl during initiation of a finishing cycle, but prior to discharge of parts and media from the hopper into the bowl, the rotor associated with the bottom of the finishing chamber is activated so as to slowly rotate. Thereafter the gate at the bottom of the hopper is opened to provide controlled discharge of parts and media onto the slowly-rotating rotor which immediately effects outward dispersion of the parts so as to minimize buildup of parts at the center of the rotor, and hence minimize impacting of the parts against one another during the discharge from the hopper into the finishing chamber. In addition, after the parts have been finished due to higher rotation of the rotor within the finishing chamber and the resulting tumbling and mixing of the parts and media within the bowl, the rotor speed is again reduced to a low rotational speed, and the swing arms connected to the bowl are drivingly engaged and swung upwardly so that the bowl is swung upwardly through an angle in excess of 90 degrees, causing the bowl to be positioned over the tray arrangement with the bowl being in a slightly downwardly inverted and angled relationship. In this relationship, there is a tendency for the mass of parts and media to remain somewhat clumped together adjacent a lower corner of the chamber, and the slow rotation of the rotor and the ribs thereon cause some of the parts and media to be lifted upwardly within the bowl in the vicinity of the bottom wall thereof, which hence reduces the speed with which the parts are discharged, and hence results in the discharge of parts occurring in a more uniform manner, rather than being discharged as one big mass. This accordingly minimizes the impacting of the parts with one another, particularly when the parts contact the grate and their falling motion is stopped, whereby less surface damage is believed to occur due to the improved discharge motion achieved by the continued slow rotation of the rotor during the discharge phase.

Figure 1:
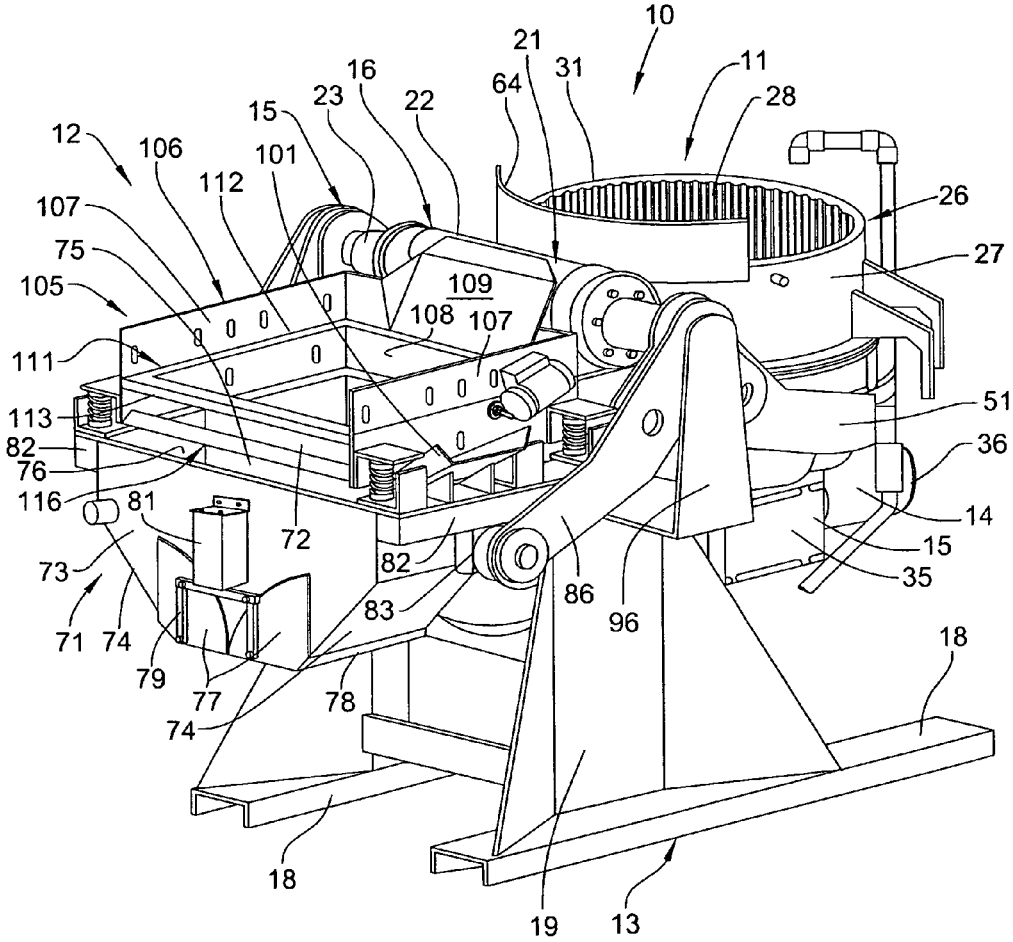
FIG. 1 is a perspective view of an improved finisher arrangement having parts/media loading and unloading capabilities in accordance with the present invention, which view illustrates a centrifugal parts finisher and a parts/media handling arrangement disposed in their normal lowered positions in close proximity to one another but disposed on generally opposite sides of a single centrally-positioned rotary drive.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement or apparatus, or designated parts thereof. Said terminology will include the words specifically mentioned, derivatives thereof, and words of similar import.

DETAILED DESCRIPTION

Referring to the drawings, and specifically FIGS. 1-5, there is illustrated a finisher arrangement 10 in accordance with the present invention. This finisher arrangement includes a parts finisher 11 of the centrifugal type, and a material handling apparatus 12, both of which are supported for vertical swinging movement on a support frame 13. The parts finisher 11 and the material handler 12 are both connected to a linkage arrangement 14 which includes substantially identical arm assemblies 15 disposed on opposite sides of the finisher arrangement for permitting independent and selective vertical swinging of the parts finisher 11 and material handler 12. A rotary drive arrangement 16 is mounted on the frame and extends transversely thereacross at a location between the finisher apparatus 11 and handler 12 for providing driving coupling engagement to each of the arm assemblies 15, as described hereinafter.

Figure 5:
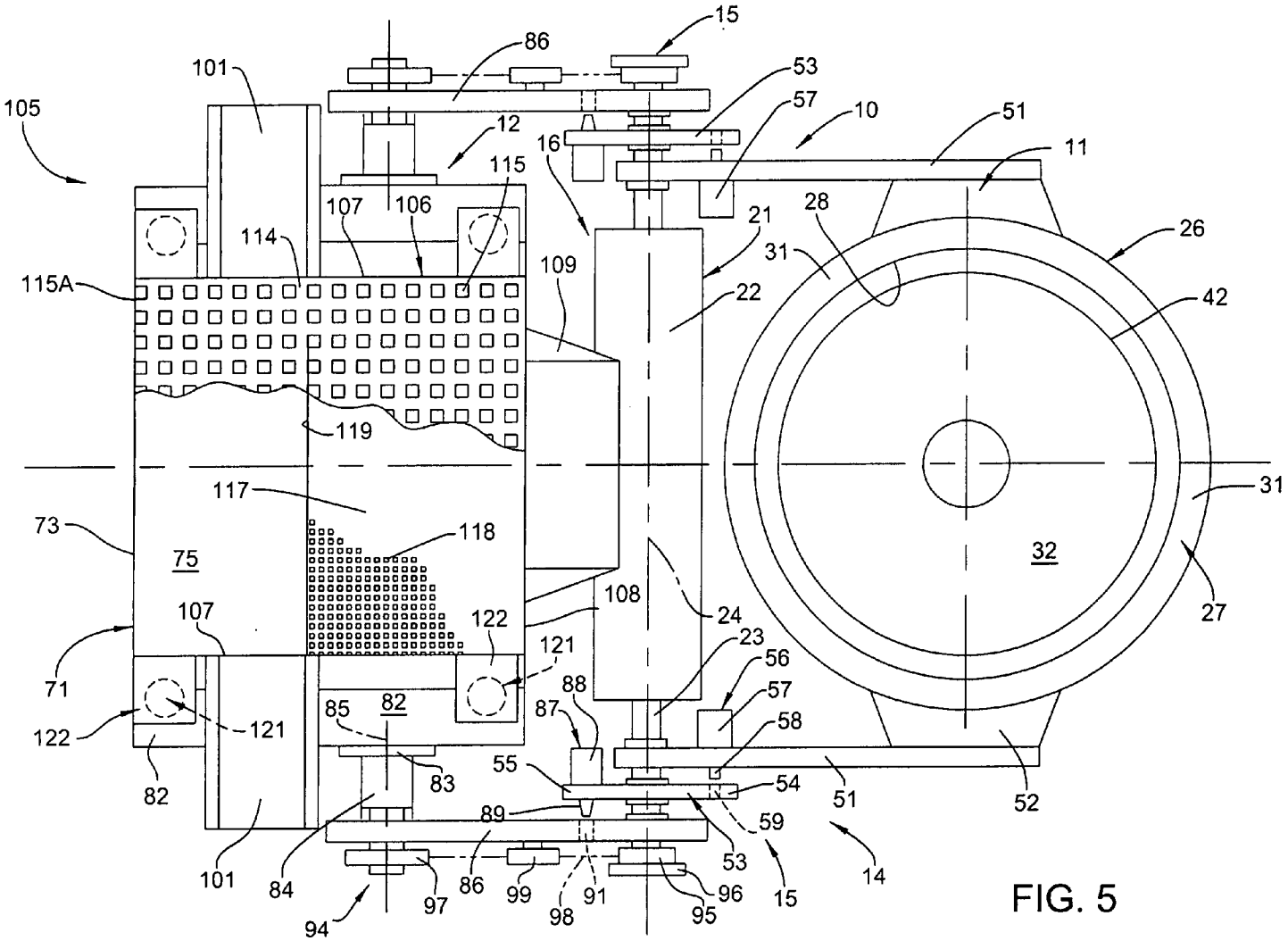
FIG. 5 is a diagrammatic top view of the finisher arrangement when the finishing device and handling arrangement are in their lowered positions substantially as illustrated in FIG. 1.

The frame 13 is of a small and compact design and includes a base defined by a pair of horizontally elongate rails or skids 18 which are sidewardly disposed in generally parallel relationship, and a pedestal 19 which transversely rigidly joins the skids together at a location intermediate the ends thereof. The pedestal is cantilevered upwardly and is disposed generally between the sidewardly-adjacent finisher apparatus 11 and material handler 12 when the latter are in their normal lowered positions as illustrated by FIGS. 1 and 5. The finisher device 11 and handler 12, when in this lowered normal position, are supportingly seated on seats or supports which are fixed to the frame 13.

The rotary drive unit is comprised by a single conventional rotary hydraulic actuator 21 which includes an elongate cylindrical housing 22 fixedly mounted on the upper end of the pedestal 19 so as to extend generally transversely and horizontally crosswise of the apparatus. This hydraulic drive unit includes an internal torque generating mechanism, typically of the helical type, which effects rotation of an output shaft 23 which in the illustrated unit projects coaxially outwardly from opposite ends of the housing and is rotatable about its longitudinal central axis 24, the latter being oriented to extend horizontally in transverse relationship to the lengthwise extent of the overall arrangement. The rotary hydraulic drive actuator 21 enables the output shaft 23 to be reversely rotated through a desired angular extent, while enabling generation of significantly high output torque. Rotary hydraulic actuators are conventional and well known, and one common brand is manufactured by Helac.

With respect to the parts finisher 11, it comprises a centrifugal type finishing device 26 which is generally well known, and the basic structure and operation thereof is described in U.S. Pat. No. 5,012,620 (owned by the assignee hereof), the disclosure of which is incorporated herein by reference. However, the basic structure and operation of the finishing device 26 is briefly described herein for purposes of completeness.

Figure 8:
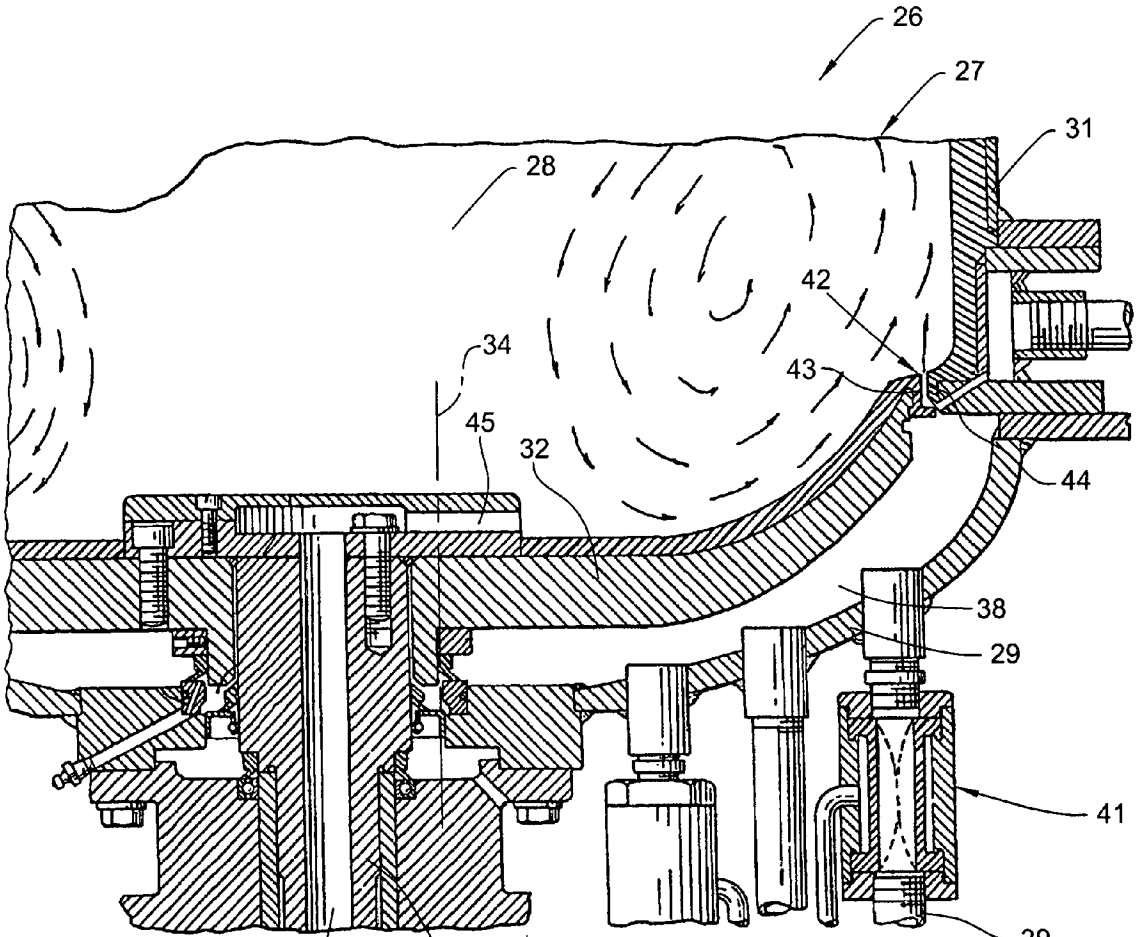
FIG. 8 is a fragmentary sectional view which illustrates the basic construction of the bowl and specifically the rotatable spinner or rotor associated with a bottom of the finishing chamber.
Figure 9:
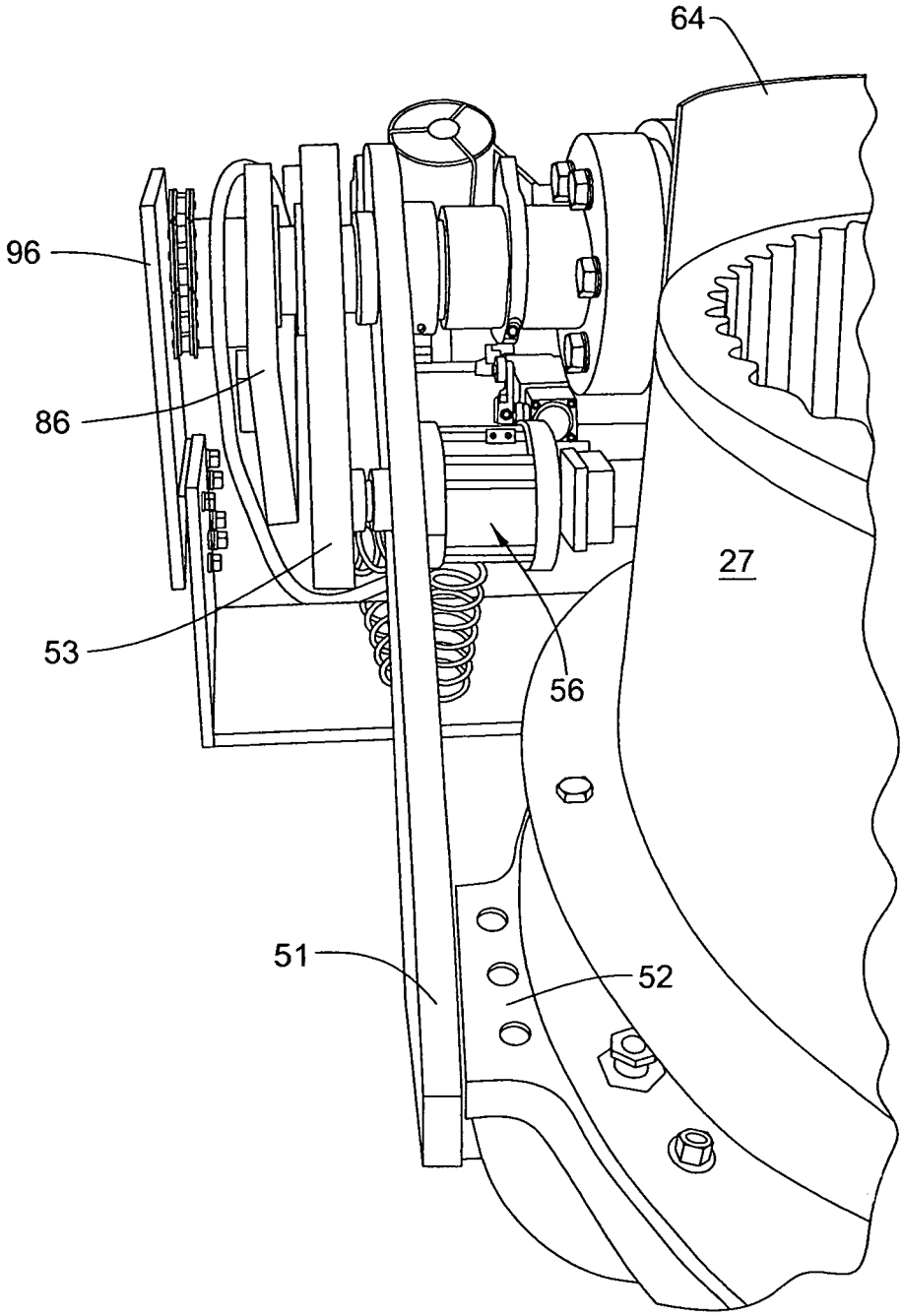
FIG. 9 is a view taken from the rightward end of FIG. 5 and showing the relationship of the arm mechanism to the main drive shaft.

The finishing device 26 includes a bowl or tub-shaped container 27 which defines an upwardly-opening finishing chamber 28 (FIGS. 5 and 8). The bowl 27 is defined principally by a bottom wall 29 joined to an upwardly-projecting annular edge or side wall 31 which terminates at a free upper edge. A radially enlarged rotor 32, sometimes referred to as a spinner, is positioned adjacent and overlies the bottom wall and is coupled to a drive shaft 33 which projects vertically downwardly in sealed relationship through the bottom wall 29 for joinder to a drive gear mechanism 35, which in turn is joined to a drive motor 36. The drive gear mechanism 35 and drive motor 36 are both carried on the bowl 27. The upper surface of the rotor can be provided with ribs or protrusions to assist in mixing of the chamber contents.

The rotor 32 and bottom wall 29 cooperate to define a pressure chamber 38 therebetween which is supplied with fluid, for example water, which is utilized in the finishing operation. The fluid is supplied to the chamber 38 from a suitable supply pipe 39 having a control valve 41 associated therewith. The supply pipe 39 in turn is joined through a flexible pipe or conduit to a suitable pressurized supply source for the fluid.

As illustrated in FIG. 8, the rotor 32 extends radially so as to cover substantially the entire bottom wall 29 and hence the upper surface of the rotor defines the active bottom wall of the finishing chamber 28. The annular outer edge of the rotor cooperates with the surrounding annular housing to define an annular seal 42, the latter being defined by an annular tip 43 on the rotor, the latter typically being of a suitable flexible material, and cooperating with an annular seal part 44 provided on the side wall. These seal parts define a suitable narrow gap, particularly when the chamber 32 is filled with pressurized fluid, to allow limited flow of pressurized fluid upwardly through the seal into the finishing chamber 28. This effectively cools the seal, prevents fines and other solids from contaminating the seal, and provides longer seal wear life.

The liquid is drained from the finishing chamber 28 through one or more ports 45 formed in the rotor, which ports in turn communicate with a passage 46 which extends coaxially downwardly through the drive shaft, the latter passage being connected in a conventional manner to a suitable drain or liquid collecting arrangement.

As is conventional, the inner surface of the annular side wall 31 and the exposed upper surface of the rotor 32 are preferably provided with a suitable lining or coating thereon, typically a coating of urethane.

Figure 4:
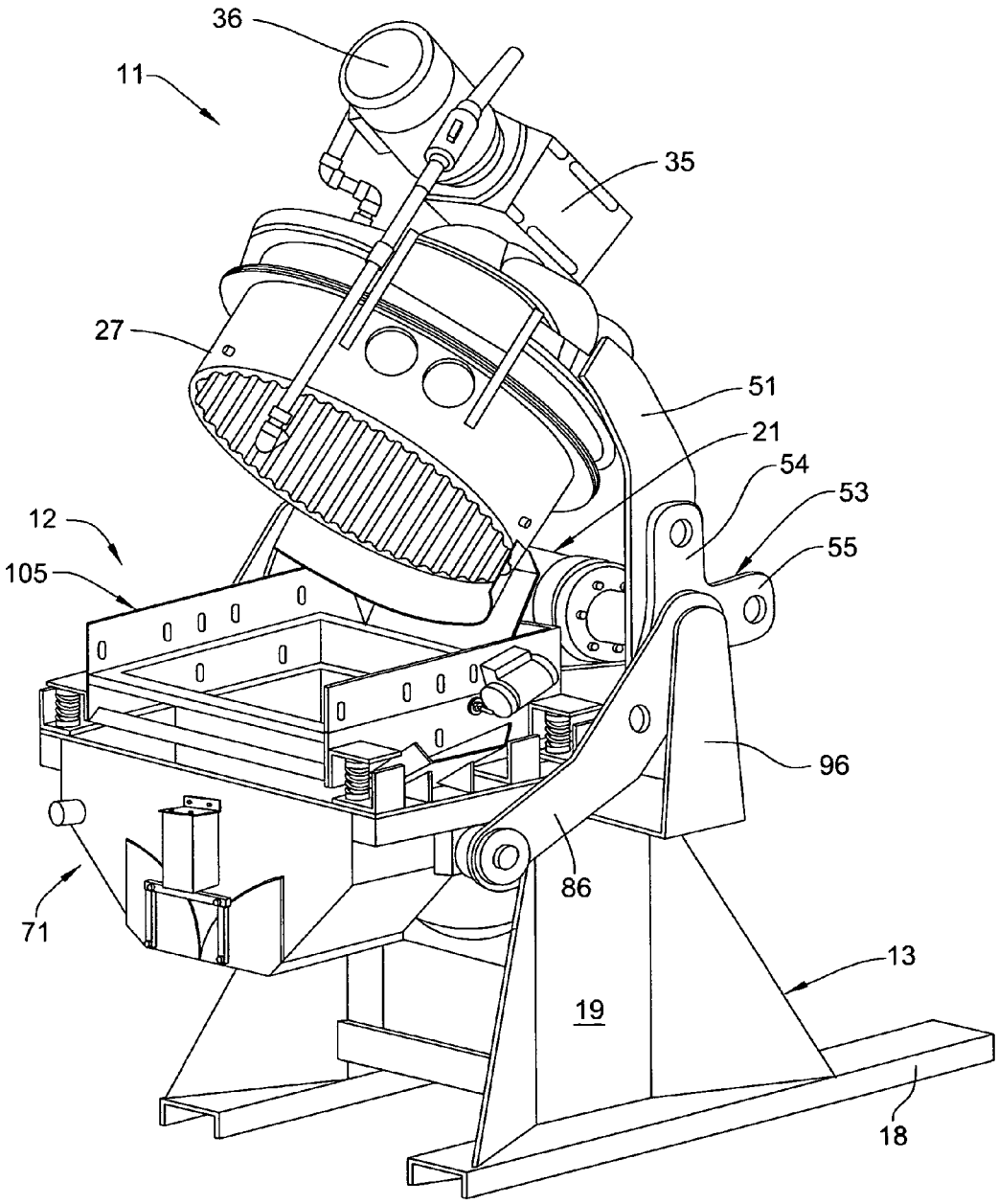
FIG. 4 is a perspective view which illustrates the parts/media handling arrangement in its lowered normal position, and the parts finisher swung upwardly into a raised position wherein the bowl is partially inverted and disposed in close proximity over a tray of the parts/media handler to permit discharge of parts, media and liquid from the bowl into the tray.

To control vertical swinging movement of the finishing device 26 from its loading and operational position of FIG. 1 into its dumping or unloading position of FIG. 4, the pair of arm arrangements 15 each include a first elongate swing arm 51 having its inner end rotatably supported on the drive shaft 23, and its outer end rigidly joined to a side mounting flange 52 which is fixed to the side wall of the tub adjacent the lower extremity thereof.

To affect driving, each arm mechanism 15 includes a driving arm member 53 formed as a generally L-shaped lever member which, adjacent its apex, is non-rotatably secured to the drive shaft 23 so that the arms 54 and 55 thereof project radially outwardly. The one arm 54 projects so as to be disposed in close sideward proximity to the first elongate swing arm 51, and a drive coupler or clutch device 56 is provided for creating a driving coupling therebetween. The drive coupler 56 comprises a generally linear activator 57 which is mounted on the swing arm 51 and has a linearly extendable coupling pin 58 which projects transversely toward the arm 54 so that when the activator 57 is actuated, such as electrically or pneumatically, the pin 58 moves outwardly to project into an opening 59 formed through the drive arm 54, thereby non-rotatably coupling the swing arm 51 to the arm 54 which in turn is non-rotatably coupled to the drive shaft 23. Rotary activation of the drive shaft 23 by the hydraulic actuator 21 thus effects vertical swinging of the finishing device 26 between the normal operational and loading position illustrated in FIG. 1 and the unloading position illustrated in FIG. 4.

The frame 13 is also provided with support arms which protrude outwardly from the pedestal 19 and project under the bowl 27 to provide stationary support for the bowl when in its normal operational and loading position.

Figure 6:
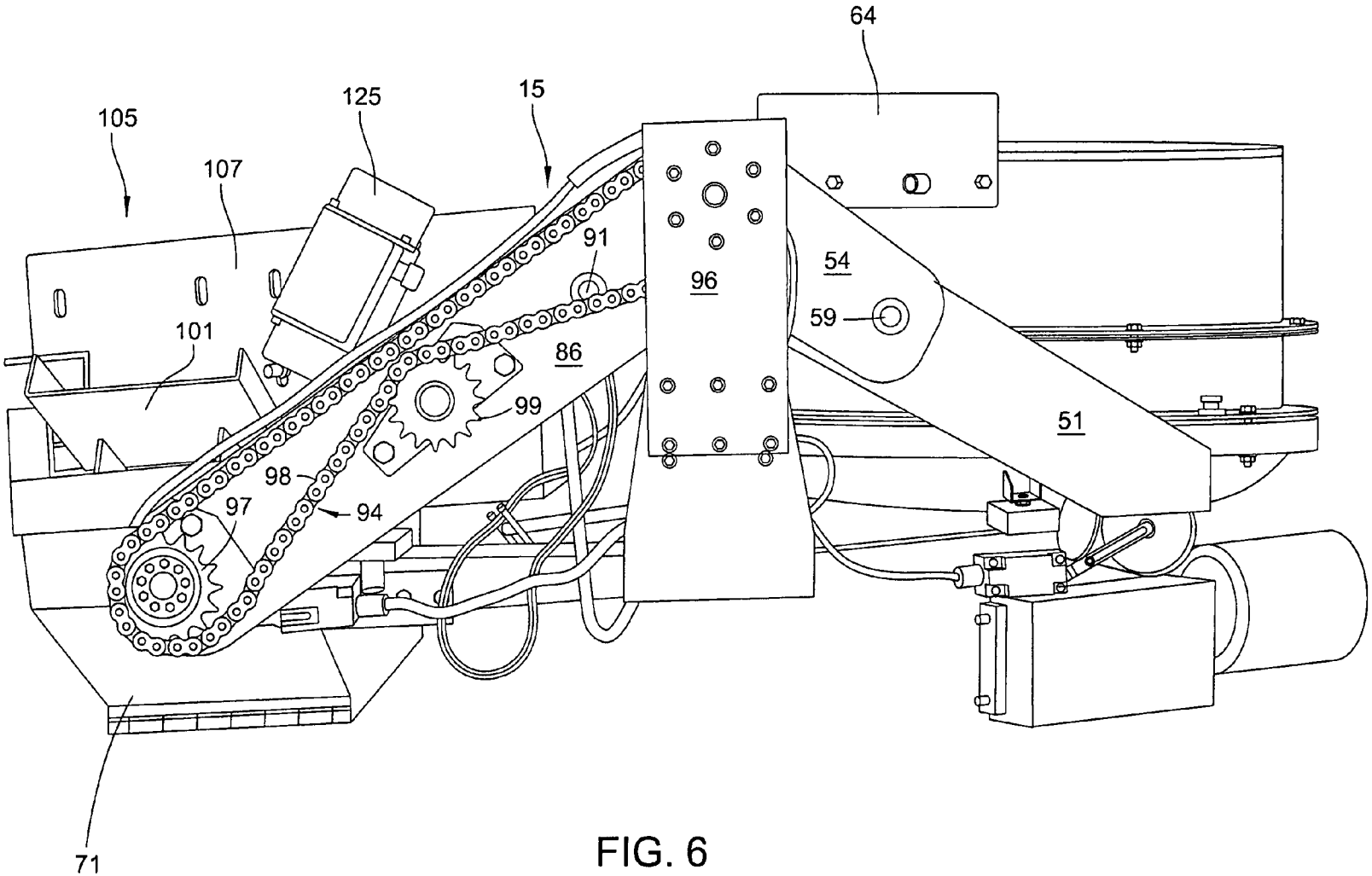
FIG. 6 is a side elevational view taken from the bottom side of FIG. 5 and showing the overall arrangement in its lowered or normal condition.
Figure 7:
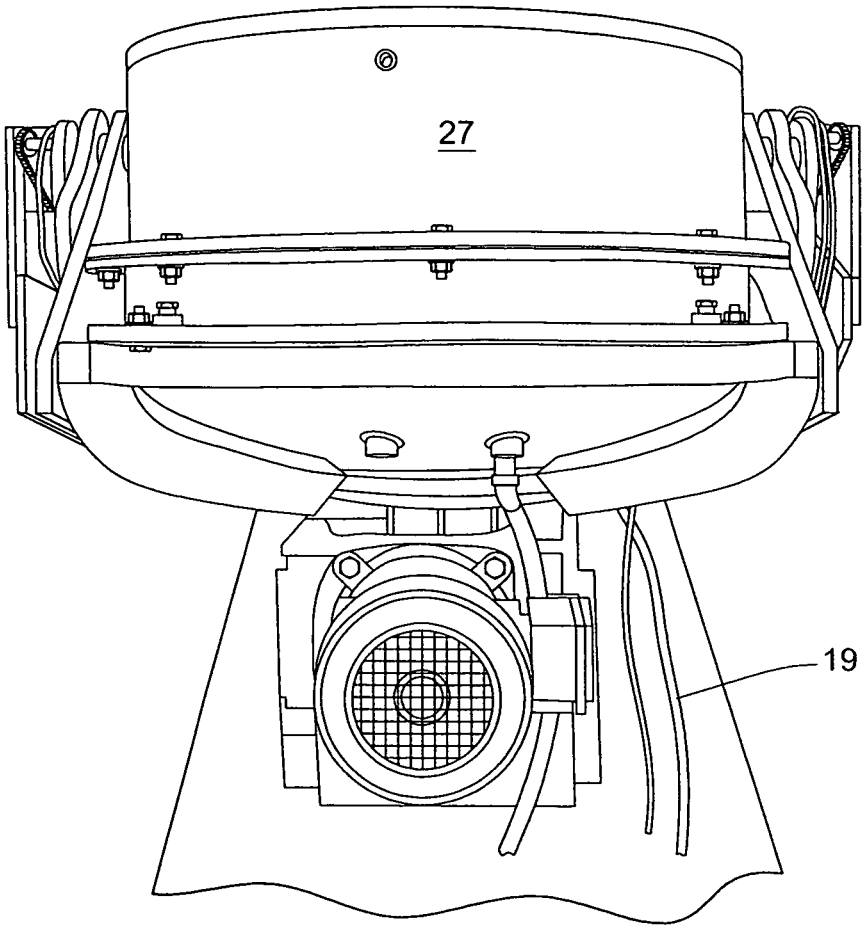
FIG. 7 is an end elevational view taken from the rightward end of FIG. 5 and showing the rotary centrifugal finishing bowl.

As illustrated by FIGS. 1 and 6, the bowl 27 is preferably provided with an upwardly projecting discharge guide 64 associated with the upper edge of the finishing chamber. This guide 64 extends circumferentially around only a fraction of the circumference of the open mouth of the bowl, namely through an angle significantly less than 180 degrees, typically about 135 degrees, and is positioned so as to be on the side of the bowl which is disposed most closely adjacent the rotary actuator 21. The guide 64 projects upwardly only a limited extent, such as about four to six inches above the top edge of the bowl side wall, and is provided solely to provide an extended guide path for permitting slidable discharge of parts and media from the bowl when the latter is in the raised and tilted unloading position of FIG. 4. When in this latter position, the guide 64 assists in bridging the gap so as to permit more controlled and smooth discharge of parts into the material handler 12, as described hereinafter.

Considering now the material handler 12, it will be understood that the primary purpose of the material handler 12 is to handle both parts and media which are initially collected therein and then loaded into the finishing device 26, and to also receive and effect separation of the parts, media and liquid which are unloaded from the finishing device 26 back into the material handler 12 when the finishing device is in the raised unloading position shown by FIG. 4.

The material handler 12 includes an upwardly opening hopper arrangement 71 defined by spaced apart upright front and back walls 72 and 73 rigidly joined by side walls 74 which, in their lower extremities, taper inwardly toward one another. These latter walls cooperate to define a chamber 75 for permitting collection of media and parts therein, with the deposit of media and parts into the chamber 75 occurring through the open upper end 76 of the hopper. The lower end or bottom of the hopper 71, as defined between the inwardly converging side walls 74, defines a discharge opening which is normally closed by an openable gate which, in the illustrated arrangement, comprises a pair of swingable bombay doors 77 supported by hinges 78 which extend along lower edges of the sloping side walls 74. The bombay doors 77 are connected to a linkage 79 which in turn connects to an extendable piston rod of a control cylinder 81, such as a pneumatic cylinder. The latter when in its raised position maintains the bombay doors 77 closed but, when the cylinder is activated so that the piston is moved downwardly, the linkage 79 is lowered causing the bombay doors 77 to hingedly swing downwardly into an open position to allow discharge of the contents from the hopper.

The hopper arrangement 71 is rigidly secured to and between a pair of generally horizontally elongated support rails 82 (FIG. 1) which, in the normal operating position illustrated by FIG. 1, project generally horizontally toward the frame pedestal. The support rails 82 each mount thereon a downwardly projecting support block 83, the latter in turn mounting a sidewardly and horizontally protruding support shaft 84 (FIG. 5). The support shafts 84 on opposite sides of the hopper are horizontally coaxially aligned and define a transverse horizontal axis 85. The outwardly protruding support shafts 84 as disposed on opposite sides of the hopper individually cooperate with outer ends of second elongate swing arms 86 associated with the arm arrangements 15. Each swing arm 86 has the outer end thereof rotatably supported on the respective support shaft 84, and the other or inner end is rotatably supported on the drive shaft 23. The swing arm 86 is, as illustrated in FIG. 5, positioned relative to the swing arm 51 so that the driving arm member 53 is positioned therebetween relative to their axially adjacent positional relationships on the drive shaft 23.

The second elongate swing arm 86 is also independently and selectively drivingly engagable with the drive shaft 23, and for this purpose there is provided a second drive coupler or clutch 87 which includes an activator 88 mounted on the arm 55 of the driving arm member 53. The activator 88 has a pin 89 which can be transversely extended outwardly for engagement within an opening 91 formed in the swing arm 86 to cause the swing arm 86 and driving arm member 53 to be drivingly coupled together. The activator 88 is similar to the activator 57, and both can be pneumatic activators so as to control extension and retraction of the respective coupling pin.

The hopper arrangement 71 also has an anti-tilt mechanism 94 coupled thereto so as to prevent angular rotating or tilting of the material handler about the axis 85 defined by the support shafts 84. This enables the material handler 12 to remain in its desired upward or level orientation even when the material handler is swingably moved from its normal position of FIG. 1 into the bowl loading position of FIGS. 2-3.

The anti-tilt mechanism 94, in the illustrated arrangement, is defined by a chain-and-sprocket arrangement (FIGS. 5-6) which includes a first sprocket 95 which is rigidly fixedly mounted on a frame upright 96 so that the sprocket 95, while being non-rotatable, is nevertheless coaxially aligned with the axis 24 of the drive shaft 23. In fact, it is preferable to stationarily mount the sprocket 95 so that its hub is relatively rotatably supported on the drive shaft. A second identical sprocket 97 is positioned adjacent the outer end of the swing arm 86 and is non-rotatably supported on the outer end of the support shaft 84. An elongate endless chain 98 extends between and is engaged with the identical sprockets 95 and 97. An idler or tensioning sprocket 99, which is rotatably supported on the swing arm 86 at a location intermediate the length thereof, is preferably disposed in meshing engagement with one of the chain runs so as to maintain proper chain tension.

The chain-and-sprocket anti-tilt arrangement 94, as described above, creates a driving reaction between the sprockets 95 and 97 through the connection created by the chain 98 such that, whenever the swing arm 86 is swingably displaced through a defined angular extent, the chain reacts with the sprocket 97 to cause a corresponding and equal angular rotation of the sprocket 97, and a corresponding angular rotation of the material handler about axis 85, which rotation is in the opposite rotational direction relative to the rotation of the swing arm 86, thereby maintaining the material handler 12 in a level or horizontal orientation irrespective of the angular displacement of the swing arm 86.

While the disclosed chain-and-sprocket anti-tilt arrangement is desirable from the standpoint of its simplicity and compactness, it will be appreciated that other known mechanisms can be utilized for the same purpose. For example, a four bar linkage employing parallel swing arms will also permit upward swinging of the material handler while the provision of the second parallel swing arm prevents tilting of the material handler.

To facilitate loading of parts into the hopper chamber 75, the hopper arrangement 71 is preferably provided with an upwardly-facing channel-shaped loading chute 101 which is provided adjacent and fixed to an upper edge of at least one of the hopper side walls, which chute 101 protrudes outwardly and slopes upwardly a limited extent. The chute 101 can be utilized to permit parts to be manually deposited in the hopper by an operator or, alternatively, parts can be supplied to the chute from any desired handling equipment such as a conveyor or a suitable parts supply device. For convenience of operation, the hopper is preferably provided with identical chutes associated with the opposite side walls thereof so that parts can be supplied to the hopper from either side of the overall arrangement.

The material handler 12 also includes a tray arrangement 105 which is disposed above and supported on the hopper arrangement 71. The tray arrangement 105 functions as a separator for separating the parts, media and liquid deposited therein when the finisher 11 is moved into the unloading position of FIG. 4.

The tray arrangement includes an upright support wall structure 106 which is an open three-sided wall arrangement defined by a pair of generally parallel upright side walls 107 joined together by an upright front wall 108, the latter having the upper center portion thereof deformed to define a guide chute 109 which angles outwardly as it projects upwardly so as to project partially over the housing of the rotary actuator and facilitate guiding of parts and media which are dumped into the tray arrangement from the parts finisher 11.

The upright support wall structure 106 has an upper generally rectangular ring-shaped support frame 111 fixed thereto at a location spaced downwardly a small distance from the upper edges of the side walls. This support frame includes frame elements 112 which are fixed to and extend horizontally along each of the upright walls 107 and 108, and also includes a further element 113 which rigidly joins to the side walls 107 adjacent the free vertical edges thereof and projects horizontally across the open side of the support wall structure 106.

The ring-shaped support frame 111 supports thereon a flat plate-like grate 114 (FIG. 5) having a plurality of openings 115 extending therethrough. The grate 114 extends generally horizontally across the entire cross-section of the upright support wall structure 106 and functions to receive the parts, media and liquid which is unloaded from the finishing device 26. The openings 115 are sized, shaped and positioned so as to readily permit the media and liquid to pass vertically therethrough, while at the same time preventing downward passage of the parts, thereby collecting the finished parts on the grate. The parts are discharged from the grate 114 due to vibration of the tray arrangement 105, as explained hereinafter, which coupled with a slight downward slope associated with the mounting of the grate, causes the parts to move toward and be discharged at the open rear edge 115A of the grate. At this latter discharge edge, any conventional arrangement can be utilized for collecting and removing the parts, such as a collection container, a conveyor or any other suitable arrangement.

The upright support wall structure 106 also has a lower support frame 116 associated with the inner sides of the upright walls. The lower support frame 116 is similar to the upper support frame 111 but is spaced downwardly therefrom by a substantial vertical distance, typically a distance of several inches. This lower frame supports thereon a generally rectangular support screen 117 which extends transversely across the width between the side walls 107, and extends rearwardly from the front wall 108 so as to terminate at a rear or discharge edge 119 which is disposed above or more preferably at least slightly over the top opening 76 associated with the hopper chamber 75. The screen 117 has a plurality of small openings 118 therethrough which are sized and shaped to prevent passage of media therethrough, hence causing the media to collect on the screen, while at the same time allowing liquid to drain downwardly through the openings for collection in a suitable liquid collecting device or drain which is disposed below the screen in close proximity adjacent the front wall of the hopper. The vibration of the tray arrangement, as explained hereinafter, and the slight downward slope of the screen, causes the media which collects on the screen 117 to move toward the discharge edge 119 so as to cause the media to fall downwardly into and be collected within the hopper chamber 75 so as to be positioned for use in the next operational cycle of the overall arrangement.

Figure 10:
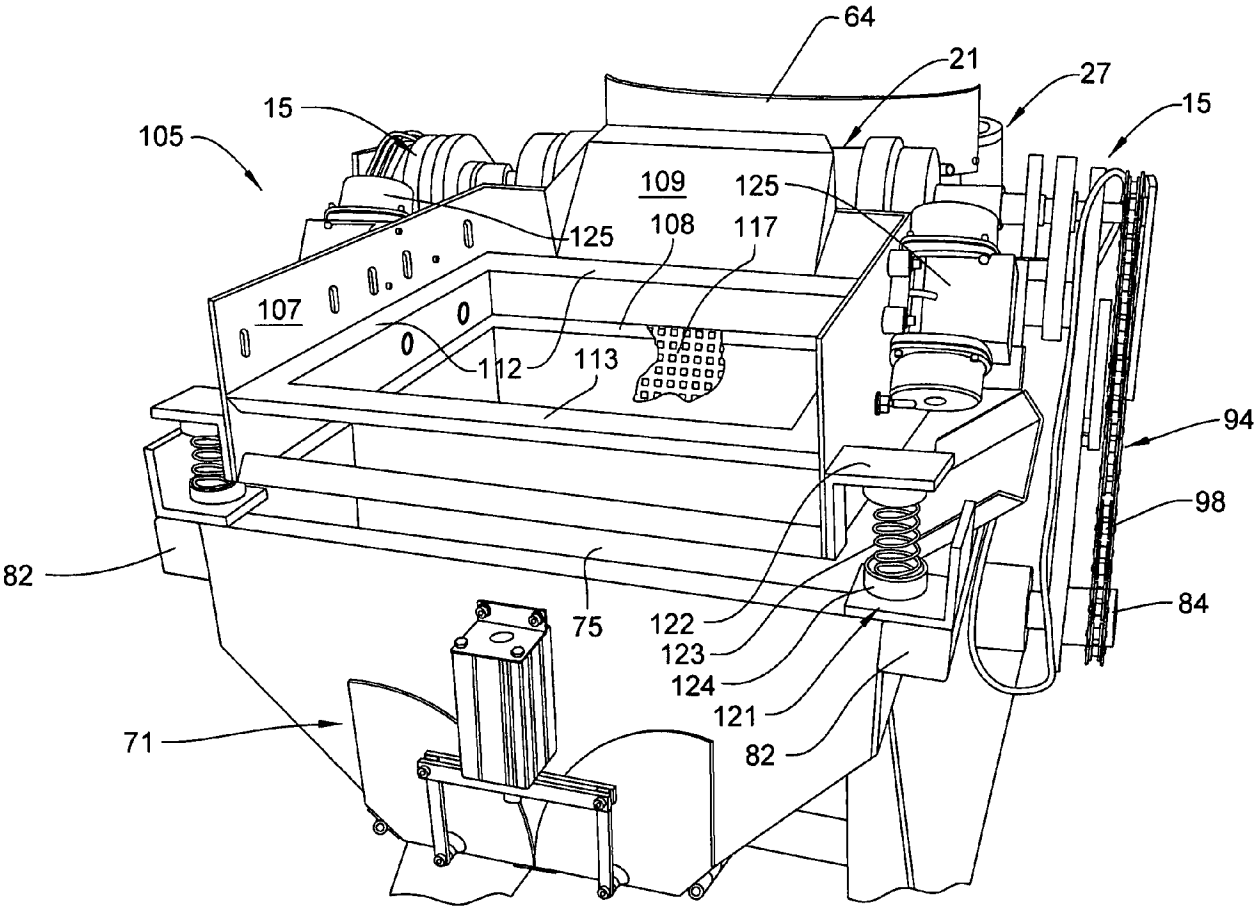
FIG. 10 is a perspective view, taken dominantly from the leftward end of FIG. 5, and illustrating the parts/media handling structure, namely the hopper arrangement and the vibratory tray structure disposed thereabove.
Figure 11:
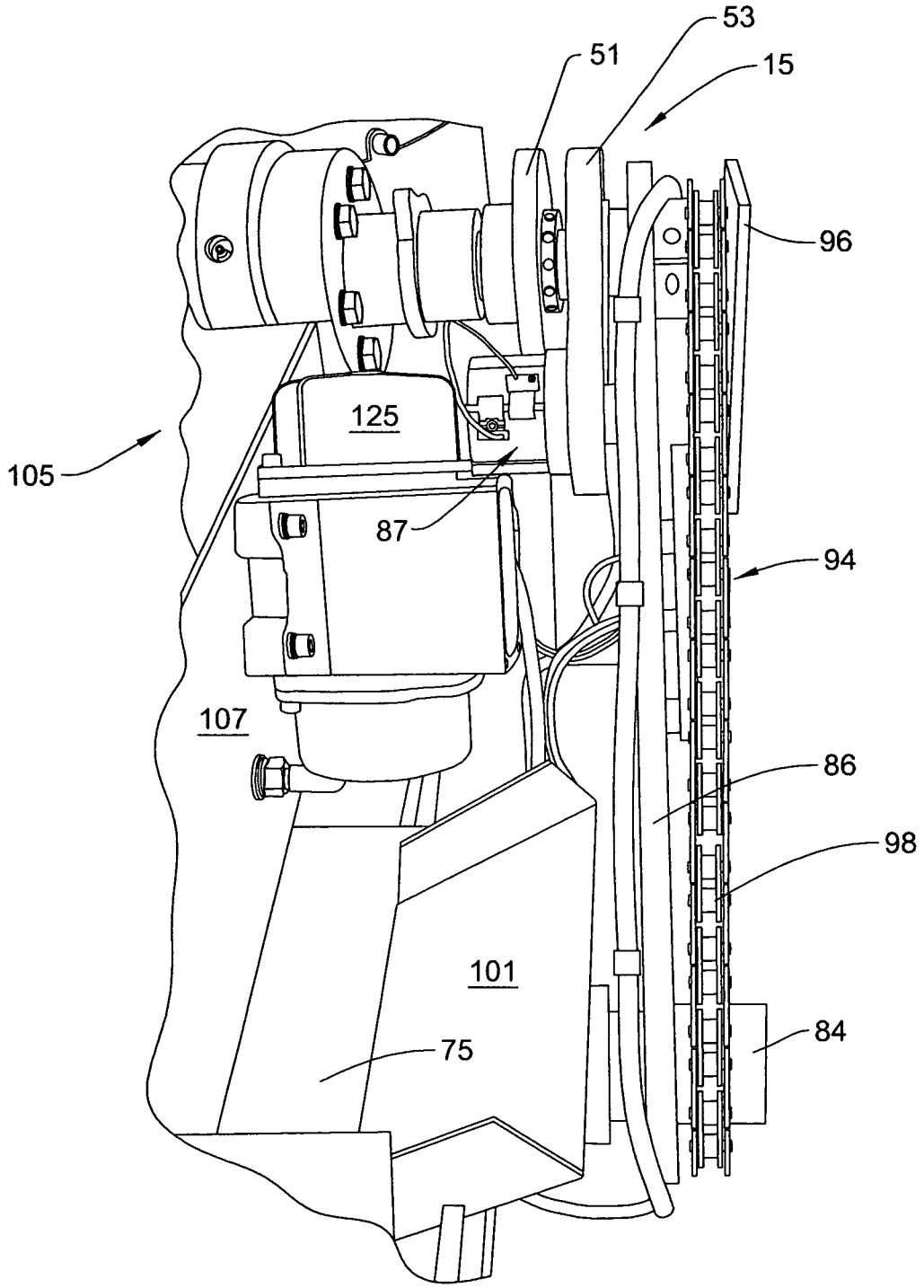
FIG. 11 is a fragmentary view taken generally from the leftward end of the arrangement and showing the arm arrangement and its cooperation with the output shaft and the parts/media handling apparatus.

To facilitate vibration of the tray arrangement 105, the latter is provided with resilient supports 121 (FIG. 10) which are positioned adjacent the four corners of the tray arrangement and couple the tray arrangement to the hopper arrangement. The resilient supports 121 are of generally conventional construction, and as illustrated by FIG. 10, each includes a top plate or seat 122 which is fixed to and projects outwardly from a respective upright side wall 107, and which rigidly joins to an upper end of a rather stiff coil spring 123. The lower end of the coil spring is in turn rigidly coupled to a seat 124 defined on the hopper support rail 82. A pair of conventional vibrators 125, such as rotatable eccentric weight vibrators, are mounted exteriorly of the opposite side walls 107. The vibrators 125 are preferably oriented to effect vibration of the tray arrangement 105 within a vertical plane which extends lengthwise of the overall arrangement, that as perpendicular to the rotational axis 24, so as to facilitate the rearward movement of the parts and media which are respectively deposited on the grate 114 and screen 117.

The operational process of the finisher arrangement 10 according to the present invention will now be briefly described. In the following description, it will be understood that this arrangement is of the batch type, and that the following description hence relates to one overall cycle associated with the treating and handling of a batch of parts.

The finisher arrangement 10 is normally maintained in the position illustrated in FIG. 1, in which position the upwardly facing hopper and tray arrangement and the upwardly facing finishing bowl are disposed closely adjacent one another in approximately level orientation on opposite sides of the centrally-positioned rotary drive unit 21. The hopper 71 is initially provided with media therein in accordance with the desired type of finishing operation, which media can be initially manually deposited in the hopper, or may already be present in the hopper as a result of the media having been collected and deposited therein at the end of the prior operational batch cycle. The batch of parts or workpieces is then supplied into the hopper through one of the chutes 101. The parts may be manually fed into the hopper, or may be supplied via a conveyor or any other suitable parts handling device. The parts are deposited into the hopper after the media since the latter cushions the parts.

The activator 88 is then activated so that the locking pin 89 is extended into engagement with the second elongate swing arm 86, whereby the swing arm 86 and the adjacent drive member 53 are rotatably locked or coupled together. The hydraulic actuator 21 is then activated in a first rotational direction to cause the swing arms 86 to swing upwardly (clockwise in FIGS. 1 and 2), which vertical swinging movement extends through an angle in the neighborhood of about 180 degrees.

Figure 2:
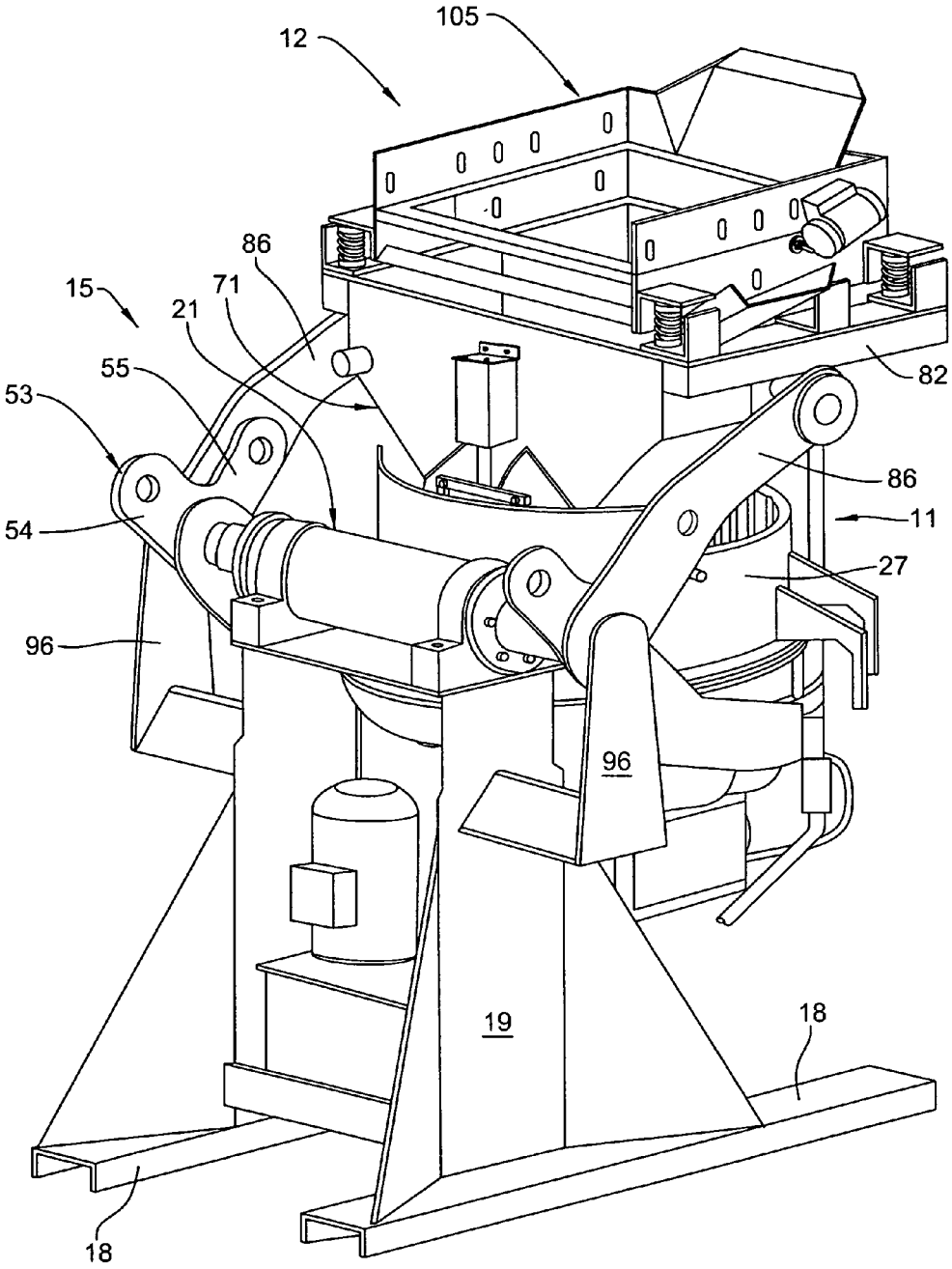
FIG. 2 is a perspective view similar to FIG. 1 but illustrates the parts/media handling apparatus swung upwardly into a raised position wherein it is disposed over a finishing chamber defined by the parts finisher so as to permit discharge of parts and media from a hopper into the finishing chamber.
Figure 3:
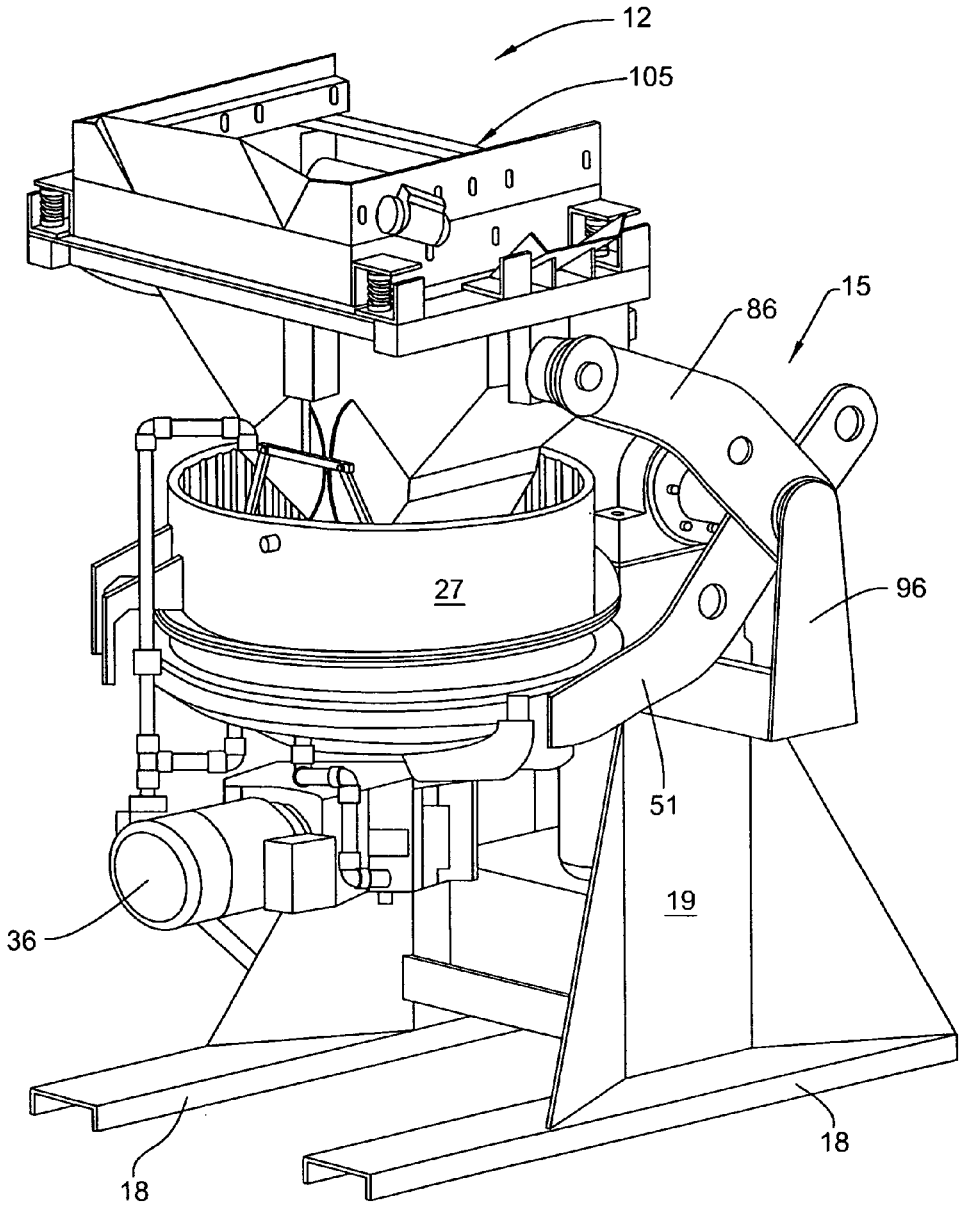
FIG. 3 is a perspective view taken generally from the diametrically opposite side of the arrangement shown in FIG. 2.

During this swinging movement, the anti-tilt arrangement 94 maintains the material handler 11 in its level (i.e., vertically suspended) orientation as the material handler is swung upwardly over the top of the actuator 21. The vertical swinging movement continues until the hopper 72 is moved over and lowered downwardly so that the lower portion of the hopper 72 protrudes partway down into the interior of the finishing chamber 28 substantially as illustrated by FIGS. 2 and 3. The movement of the hopper is such as to cause the discharge opening of the hopper, as closed by the bombay doors 77, to be disposed below the upper edge of the bowl 27, with this discharge opening of the hopper preferably being disposed at a location spaced downwardly from the upper edge which is about one-third to about one-half the overall height of the finishing chamber 28. This results in the hopper discharge opening being in close proximity to the bottom surface of the finishing chamber 28, while at the same time providing sufficient clearance for opening of the bombay doors. Prior to opening of the bombay doors, the rotor 32 is activated and rotationally driven at a slow rotational speed, and at the same time the fluid within the pressure chamber 38 is supplied to the annular seal 42 so as to lubricate and cool the seal, and allowing some of this fluid to pass through the seal gap into the finishing chamber. The bombay doors 77 on the hopper are then opened to permit the parts/media mixture to be deposited onto the rotating rotor 32. Due to the slow rotation of the rotor, however, this immediately causes the parts/media mixture to be radially dispersed outwardly as it is being deposited thereon, thus minimizing the buildup of material at the center of the rotor and minimizing the contacting or impacting of the parts against one another. This contacting and impacting is further minimized by the short vertical drop between the discharge opening of the hopper and the opposed upper face of the rotor 32.

Upon completion of the discharge from the hopper, the bombay doors are closed, and the hydraulic actuator 21 is reversely rotationally energized to cause the material handler 12 to be swingably returned from the loading position of FIGS. 2-3 back to its original or normal operating position (FIG. 1). When handler 12 reaches this latter position, the activators 88 are reversely energized to withdraw the locking pins 89 from their engagement with the elongate swing arms 86, thereby disconnecting the driving connection between the swing arms 86 and the rotary drive shaft 23.

After the parts/media mixture has been deposited into the finishing chamber 28 of the bowl 27, the rotation of the rotor or spinner 32 continues but at a significantly higher operational speed (which is at least several times greater than the slow rotor rotation during loading of the bowl) so as to cause more active agitation, mixing and tumbling of the parts and media within the finishing chamber. This more active agitating, mixing and tumbling of the parts/media mixture together with the liquid supplied thereto (which can be water or any other suitable conventional finishing liquid) continues for whatever time period is deemed desirable or necessary to provide for desired surface finishing of the parts.

Upon completion of the surface finishing cycle, the operational speed of rotation of the rotor 32 is significantly reduced back to a slow rotational speed, and the activators 57 are energized so as to project the pins 58 into the openings 59, thereby providing a non-rotatable coupling between the first swing arms 51 and the adjacent drive members 53. The rotary actuator 21 is then activated so as to effect rotation of the shaft 23 which in turn causes rotation of the swing arms 51 (counter-clockwise in FIG. 1) which rotation continues through an angle in excess of 90 degrees, and more specifically through an angle in the neighborhood of about 135 degrees, thereby causing the finishing bowl 27 to be tilted into the unloading position illustrated by FIG. 4, in which position the bowl has been partially inverted so that the open mouth of the bowl opens downwardly at an angle of about 45 degrees relative to the vertical. In this position the lower extremity of the open mouth of the bowl, and specifically the guide or extender wall 64 associated therewith, projects downwardly in closely adjacent and vertically overlying relationship to the guide chute 109 formed on the front wall of the tray arrangement 105. In this orientation the parts/media and liquid mixture within the finishing chamber 28 can slide out of the bowl and across the guide 64 and then fall downwardly through a very small vertical distance onto the grate 114 (which is not shown in FIGS. 1-4 and 10 for convenience in illustration). During the upward swinging of the finishing device 26 into the raised unloading position of FIG. 4, and while the finishing device is maintained in this raised unloading position, the rotor 32 continues to rotate at a slow rotational speed. This is advantageous since, when the bowl passes through an upright vertical orientation and moves into its downwardly inclined unloading orientation as illustrated in FIG. 4, the rotation of the rotor and its contact with the parts/media mixture causes some of the mixture, particularly the lower part of the mixture which contacts the rotor, to be circumferentially displaced upwardly along one side of the bowl. This hence tends to counter and accordingly slow down the outward discharging movement of the parts/media mixture. The discharge of this mixture from the bowl into the tray arrangement hence occurs less as a solid mass or glob, but rather as a more steady stream which, when coupled with the small vertical drop onto the grate and the forward advancing of parts along the grate towards its discharge edge due to grate vibration, hence minimizes direct contacting and impacting of the parts against one another.

When the mixture has been discharged from the bowl onto the grate, the rotary drive 23 is reversely energized to cause the centrifugal finishing device 26 to be returned to its normal or original position, namely its operational position illustrated in FIG. 1, in which position the finishing device 26 is supported on seats associated with the frame support arms. The activator 57 associated with each swing arm 51 is then de-energized or conversely reversely energized so as to retract the lock pin 58, thereby disconnecting the rotary drive connection between the arms 51 and the drive members 53.

With respect to the mixture deposited on the grate 114, the media and liquid will readily pass vertically downwardly through the rather large openings 115 associated with the grate, whereas the parts are prevented from passing downwardly and hence collect on the grate. Since the tray arrangement 105 is being vibrated by the vibrating devices 125 throughout this entire unloading operation, the vibration causes the parts to creep or move toward the free or discharge edge 115A of the grate, from which the parts are then removed, either manually or automatically by being transferred to any suitable parts collecting or transferring device.

As to the media and liquid which passes through the grate, it falls downwardly onto the screen 117 located therebelow. This screen has the plurality of small openings 118 therethrough which permits the liquid to pass therethrough into a suitable collecting drain or device located below the screen. The media, however, collects on the screen and, due to the vibration of the tray arrangement, the media creeps or moves toward the rear discharge edge 119, from which the media falls back into the hopper chamber 75 so as to be reusable during the next batch cycle of operation.

In the operational process as summarized above, the slow rotational speed of the rotor during the discharging of the parts/media mass from the hopper into the bowl, and during the swinging of the bowl and the discharging of the parts/media mass into the tray arrangement, is typically about one-twelfth to about one-eighth the operational rotational speed of the rotor during the parts surface finishing cycle.

However, the exact selected speed ratio is determined based on the nature of the parts and the finishing media used in conjunction therewith.

With the finisher arrangement 10 of this invention, as depicted by FIG. 1, the overall arrangement is of a small and compact nature, and in particular results in the finishing bowl and the material handler, when in their normal adjacent and side-by-side relationship, being at a relatively low level so that an operator can readily see and access the interior of both devices. In addition, since both the finisher 11 and the material handler 12 are positioned in close proximity and coupled to and on opposite sides of a single compact rotary drive, and are additionally both drivingly coupled to this same single drive for swinging movement between their home and discharge positions about a common transverse axis, the overall arrangement provides increased structural simplicity and compactness, whereby significant economies of manufacture and efficiency of operation are believed achievable.

In the discussion herein relative to surface finishing of parts, it will be understood that the parts are commonly of metal, and that the surface finishing may be for various purposes such as polishing, burnishing, deburring, or other known techniques.

The screen 117 can be provided with openings 118 sized to permit not only liquid passage therethrough, but also passage of worn or broken media particles as well as workpiece fines to permit disposing thereof. In addition, the screen 117 and grate 115 are both readily interchangeable to permit use of grates and screens which have different openings associated therewith to permit optimum operational performance of the finisher arrangement.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A finisher arrangement for surface finishing parts, comprising:

a frame;

a drive unit comprising a rotary actuator mounted on the frame and including a rotary drive shaft supported for rotation about a substantially horizontal axis;

a handling device supported in a first position disposed closely horizontally adjacent a first side of the rotary drive shaft, the handling device including an upward opening hopper for accommodating therein a mixture containing a quantity of finishing media and a plurality of loose parts;

a centrifugal finishing device supported in an operational position disposed closely horizontally adjacent a second side of the rotary drive shaft, the centrifugal finishing device comprising an open bowl-shaped container defining therein an upwardly opening finishing chamber for deposit of the mixture therein;

a first drive linkage drivingly connectable between the handling device and the rotary drive shaft for vertical upward swinging movement of the handling device about the substantially horizontal axis from the first position into a second position wherein the upward opening hopper is disposed over a mouth of the upwardly opening finishing chamber for enabling discharge of the mixture from the upward opening hopper into the centrifugal finishing chamber; and a second drive linkage drivingly connectable between the centrifugal finishing device and the rotary drive shaft for vertical upward swinging movement of the centrifugal finishing device about the substantially horizontal axis from the operational position into an unloading position wherein the open bowl-shaped container is disposed in a partially inverted position generally above the handling device for discharge of the mixture from the open bowl-shaped container into the handling device.

2. The finishing device of claim 1, wherein:

the handling device includes a screen for accepting the mixture and a fluid thereon, with the finishing media of the mixture and the fluid passing through the screen, but not the loose parts of the mixture.

3. The finishing device of claim 2, wherein:

the handling device includes at least one vibrating mechanism for vibrating the screen to move the parts of the mixture on the screen.

4. The finishing device of claim 1, wherein:

the first drive linkage comprises a pair of first drive arms, the pair of first drive arms straddling and being rotatably connected to the handling device, the pair of first drive arms having a first fixed pivot co-linear with the substantially horizontal axis; and the second drive linkage comprises a pair of second drive arms, the pair of second drive arms straddling and being non-rotatably connected to the centrifugal finishing device, the pair of second drive arms having a second fixed pivot co-linear with the first fixed pivot and the substantially horizontal axis.

5. The finishing device of claim 4, further including:

a driving arm non-rotatably fixed to the rotary drive shaft of the drive unit, the driving arm being configured to be selectively engaged with the first drive arms;

wherein the driving arm rotates the first drive arms with rotation of the rotary drive shaft when the driving arm is engaged with the first drive arms; and wherein the driving arm does not rotate the first drive arms with rotation of the rotary drive shaft when the driving arm is not engaged with the first drive arms.

6. The finishing device of claim 5, wherein:

the driving arm is configured to be selectively engaged with the second drive arms;

the driving arm rotates the second drive arms with rotation of the rotary drive shaft when the driving arm is engaged with the second drive arms;

the driving arm does not rotate the second drive arms with rotation of the rotary drive shaft when the driving arm is not engaged with the second drive arms.

7. The finishing device of claim 6, wherein:

a first one of the driving arm and the first drive arms includes a first linear actuator having a first pin and a second one of the driving arm and the first drive arms includes a first opening for accepting the first pin of the first linear actuator therein to engage the driving arm with the first drive arms; and a first one of the driving arm and the second drive arms includes a second linear actuator having a second pin and a second one of the driving arm and the second drive arms includes a second opening for accepting the second pin of the second linear actuator therein to engage the driving arm with the second drive arms.

8. The finishing device of claim 1, wherein:

the handling device includes a first screen for accepting the mixture and a fluid thereon, with the finishing media of the mixture and the fluid passing through the first screen, but not the loose parts of the mixture;

the handling device further includes a second screen located below the first screen for accepting the finishing media and the fluid thereon, with the fluid, but not the finishing media of the mixture, passing through the second screen.

9. The finishing device of claim 1, wherein:

the centrifugal finishing device includes a rotating rotor at a bottom of the upwardly opening finishing chamber for mixing the mixture within the upwardly opening finishing chamber.

10. The finishing device of claim 1, wherein:

the handling device is at least partially located within the upwardly opening finishing chamber of the centrifugal finishing device when the handling device is in the second position.

11. The finishing device of claim 1, wherein:

the first drive linkage includes an anti-tilt mechanism maintaining the handling device in an upright position as the first drive linkage moves the handling device from the first position to the second position, with a top of the handling device remaining substantially horizontal when the handling device is in the upright position.

12. A process of operating the finisher arrangement of claim 1, comprising:

providing a rotor at a bottom of the upwardly opening finishing chamber for mixing the mixture within the upwardly opening finishing chamber;

rotating the rotor at a first rotational speed when the mixture is discharged from the upward opening hopper into the centrifugal finishing chamber;

thereafter rotating the rotor at a second rotational speed to effect surface treatment of the parts contained within the mixture; and thereafter rotating the rotor at a third rotational speed as the open bowl-shaped container is moved into the unloading position and during discharge of the mixture from the open bowl-shaped container;

wherein the second rotational speed is greater than the first rotational speed and the third rotational speed.

13. The process of claim 12, further including:

positioning a screen within the handling device; and discharging the mixture from the open bowl-shaped container onto the screen within the handling device.

14. The process of claim 13, further including:

vibrating the screen to move the parts of the mixture on the screen.

15. The process of claim 12, further including:

providing the first drive linkage with a pair of first drive arms, the pair of first drive arms straddling and being rotatably connected to the handling device, the pair of first drive arms having a first fixed pivot co-linear with the substantially horizontal axis; and providing the second drive linkage with a pair of second drive arms, the pair of second drive arms straddling and being non-rotatably connected to the centrifugal finishing device, the pair of second drive arms having a second fixed pivot co-linear with the first fixed pivot and the substantially horizontal axis.

16. The process of claim 15, further including:

non-rotatably fixing a driving arm to the rotary drive shaft of the drive unit;

rotating the first drive arms with the driving arm during rotation of the rotary drive shaft when the driving arm is engaged with the first drive arms;

not rotating the first drive arms with the driving arm during rotation of the rotary drive shaft when the driving arm is not engaged with the first drive arms.

17. The process of claim 16, further including:

rotating the second drive arms with the driving arm during rotation of the rotary drive shaft when the driving arm is engaged with the second drive arms;

not rotating the second drive arms with the driving arm during rotation of the rotary drive shaft when the driving arm is not engaged with the second drive arms.

18. The process of claim 17, further including:

engaging the driving arm with the first drive arms by inserting a first pin extending from a first one of the driving arm and the first drive arms into a first opening in a second one of the driving arm and the first drive arms; and engaging the driving arm with the second drive arms by inserting a second pin extending from a first one of the driving arm and the second drive arms into a second opening in a second one of the driving arm and the second drive arms.

19. The process of claim 12, wherein:

providing the handling device with a first screen and a second screen located below the first screen;

passing the finishing media of the mixture and fluid through the first screen, but not the loose parts of the mixture; and passing the fluid, but not the finishing media of the mixture, through the second screen.

20. The process of claim 12, further including:

at least partially locating the handling device within the upwardly opening finishing chamber of the centrifugal finishing device when the handling device is in the second position.

21. The process of claim 12, further including:

maintaining the handling device in an upright position as the first drive linkage moves the handling device from the first position to the second position, with a top of the handling device remaining substantially horizontal when the handling device is in the upright position.

22. A finisher arrangement for surface finishing parts, comprising:

a frame;

a drive unit mounted on the frame;

a handling device including an upward opening hopper for accommodating therein a mixture containing a quantity of finishing media and a plurality of loose parts;

a centrifugal finishing device comprising an open bowl-shaped container defining therein an upwardly opening finishing chamber for deposit of the mixture therein;

a first drive linkage drivingly connectable between the handling device and the drive unit for swinging movement of the handling device from a first home position to a second position wherein the upward opening hopper is disposed over a mouth of the upwardly opening finishing chamber for enabling discharge of the mixture from the upward opening hopper into the centrifugal finishing chamber; and a second drive linkage drivingly connectable between the centrifugal finishing device and the drive unit for swinging movement of the centrifugal finishing device from an operational position to an unloading position wherein the open bowl-shaped container is disposed in a partially inverted position generally above the handling device for discharge of the mixture from the open bowl-shaped container into the handling device;

the handling device being in the first home position when the centrifugal finishing device is in the unloading position and the centrifugal finishing device being in the operation position when the handling device is in the second position;

the first drive linkage comprising at least one first drive arm rotatably connected to the handling device;

the second drive linkage comprising at least one second drive arm rotatably connected to the centrifugal finishing device; and a driving arm configured to be selectively engaged with either the at least one first drive arm or the at least one second drive arm;

the driving arm rotating the at least one first drive arm with actuation of the drive unit when the driving arm is engaged with the at least one first drive arm, thereby moving the handling device between the first home position and the second position;

the driving arm not rotating the at least one first drive arm with actuation of the drive unit when the driving arm is not engaged with the at least one first drive arm;

the driving arm rotating the at least one second drive arm with actuation of the drive unit when the driving arm is engaged with the at least one second drive arm, thereby moving the centrifugal finishing device between the operational position and the unloading position; and the driving arm not rotating the at least one second drive arm with actuation of the drive unit when the driving arm is not engaged with the at least one second drive arm.

* * * * *